US007938758B2

(12) United States Patent
Publicover et al.

(10) Patent No.: US 7,938,758 B2
(45) Date of Patent: May 10, 2011

(54) HOPPING BALL

(75) Inventors: Mark W. Publicover, Saratoga, CA (US); Jon P. Hylbert, Los Gatos, CA (US); Donald Strasser, Los Gatos, CA (US)

(73) Assignee: Mark W. Publicover, Saratoga, CA (US)

( * ) Notice: Subject to any disclaimer, the term of this patent is extended or adjusted under 35 U.S.C. 154(b) by 0 days.

(21) Appl. No.: 12/037,032

(22) Filed: Feb. 25, 2008

(65) Prior Publication Data

US 2008/0220948 A1 Sep. 11, 2008

Related U.S. Application Data

(63) Continuation-in-part of application No. PCT/US2006/033615, filed on Aug. 28, 2006.

(60) Provisional application No. 60/712,713, filed on Aug. 30, 2005.

(51) Int. Cl.
*A63B 25/08* (2006.01)
*A63B 26/00* (2006.01)

(52) U.S. Cl. ..... 482/77; 239/289; 472/134; 446/220

(58) Field of Classification Search ..... 482/77, 482/148; 472/128, 134; 446/159, 180, 183, 446/220–226, 267, 475, 483; 222/78, 79, 222/192, 608, 628; D7/515, 606; 239/23, 239/289, 333
See application file for complete search history.

(56) References Cited

U.S. PATENT DOCUMENTS

| | | | | |
|---|---|---|---|---|
| 2,004,866 | A * | 6/1935 | Haldeman | 417/357 |
| 2,619,257 | A * | 11/1952 | Posner | 222/78 |
| 2,735,589 | A * | 2/1956 | Milster et al. | 222/386.5 |
| 2,741,400 | A * | 4/1956 | Hazzard | 222/130 |
| 3,048,395 | A | 8/1962 | Hobbs | |
| 3,088,675 | A * | 5/1963 | Bone | 239/20 |
| 3,098,317 | A | 7/1963 | Guzman | |
| 3,122,130 | A * | 2/1964 | Brown et al. | 119/71 |
| 3,134,505 | A * | 5/1964 | Modderno | 222/82 |
| 3,142,932 | A | 8/1964 | Lemelson | |
| 3,179,409 | A | 4/1965 | Marino | |
| 3,520,534 | A | 7/1970 | Bennett et al. | |
| D222,807 | S | 1/1972 | Davis | |
| 4,164,284 | A | 8/1979 | Witt et al. | |
| 4,280,297 | A * | 7/1981 | Katzman et al. | 446/183 |
| 4,436,224 | A * | 3/1984 | McInerny | 222/183 |
| 4,696,398 | A * | 9/1987 | Steinmetz, Jr. | 206/521 |
| 4,932,563 | A * | 6/1990 | Diamond et al. | 222/129 |

(Continued)

FOREIGN PATENT DOCUMENTS

DE 10 2006 015 201 * 10/2006

(Continued)

OTHER PUBLICATIONS

International Preliminary Report on Patentability and Written Opinion of the International Searching Authority, mailed Mar. 3, 2008, for International Application No. PCT/US2006/033615.

*Primary Examiner* — Tatyana Zalukaeva
*Assistant Examiner* — Daniel F. Roland
(74) *Attorney, Agent, or Firm* — Klarquist Sparkman, LLP

(57) ABSTRACT

A hopping play ball has one or more water reservoirs in fluid communication with one or more squirt nozzles. The squirt nozzles are activated by a user.

27 Claims, 20 Drawing Sheets

U.S. PATENT DOCUMENTS

| | | | | |
|---|---|---|---|---|
| 5,018,449 | A * | 5/1991 | Eidson, II | 102/498 |
| 5,071,387 | A * | 12/1991 | Pottick | 446/475 |
| 5,236,384 | A * | 8/1993 | Fabricant et al. | 446/267 |
| 5,277,642 | A * | 1/1994 | Dorta | 446/76 |
| 5,785,633 | A | 7/1998 | Stroppiana | |
| 5,819,989 | A * | 10/1998 | Saraceni | 222/192 |
| 5,992,757 | A * | 11/1999 | Smith et al. | 239/17 |
| 6,010,034 | A * | 1/2000 | Walthers | 222/135 |
| 6,042,022 | A * | 3/2000 | Rogozinski et al. | 239/211 |
| 6,138,874 | A * | 10/2000 | Audrey | 222/192 |
| D435,610 | S | 12/2000 | Krämer | |
| 6,269,566 | B1 * | 8/2001 | Lo | 40/406 |
| 6,279,778 | B1 * | 8/2001 | Ho et al. | 222/78 |
| 6,340,099 | B1 * | 1/2002 | Ho et al. | 222/78 |
| 6,415,534 | B1 * | 7/2002 | Liao | 40/407 |
| 6,431,405 | B2 * | 8/2002 | Irwin | 222/192 |
| 6,702,699 | B2 | 3/2004 | Touhey et al. | |
| D496,073 | S | 9/2004 | Kramer | |
| 7,168,599 | B1 * | 1/2007 | Criswell et al. | 222/608 |
| 7,185,787 | B2 * | 3/2007 | Brown et al. | 222/79 |
| 7,475,832 | B2 * | 1/2009 | Amron | 239/23 |
| 2005/0035148 | A1 * | 2/2005 | Zimmerman | 222/79 |
| 2009/0130948 | A1 * | 5/2009 | Deasy, II | 446/220 |
| 2010/0016092 | A1 * | 1/2010 | Amron | 472/128 |

FOREIGN PATENT DOCUMENTS

| | | |
|---|---|---|
| GB | 2226769 A | 11/1990 |

* cited by examiner

HOPPING BALL

CROSS REFERENCE TO RELATED APPLICATIONS

This is a continuation-in-part of International Application No. PCT/US2006/033615, filed Aug. 28, 2006, which claims the benefit of U.S. Provisional Application No. 60/712,713, filed Aug. 30, 2005, both of which prior applications are incorporated herein by reference in their entireties.

BACKGROUND AND SUMMARY

The present disclosure relates to a play ball, particularly balls having handles and suitable for hopping by a user seated thereon.

When using such an oversized play ball, a person typically grasps handles that are affixed to and extend from ball while sitting on the ball, and then uses the legs to make repeated hops.

Described herein are recreation and play balls which includes a large hopping ball having one or more integral squirt mechanisms to shoot liquid. Arrangements are described wherein the liquid is retained within the ball itself or in a separate liquid-containing chamber attached to the ball, or wherein the liquid is supplied to the ball under pressure via a hose.

Objects, features, and advantages of the invention will become apparent from the following detailed description, which proceeds with reference to the accompanying drawing figures.

DETAILED DESCRIPTION

Figure 1B:
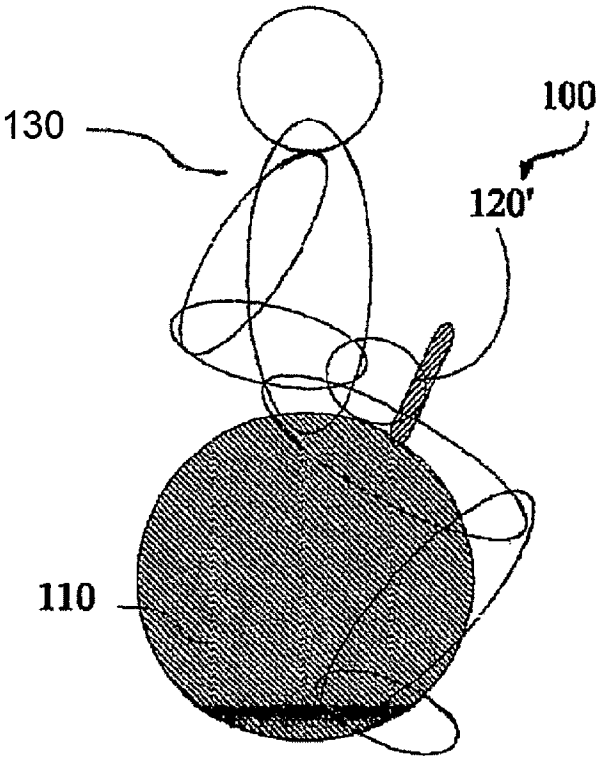
FIG. 1B PRIOR ART
FIG. 1B is a schematic side elevational view of a recreation and play ball according to the prior art with a player seated thereon.
Figure 1A:
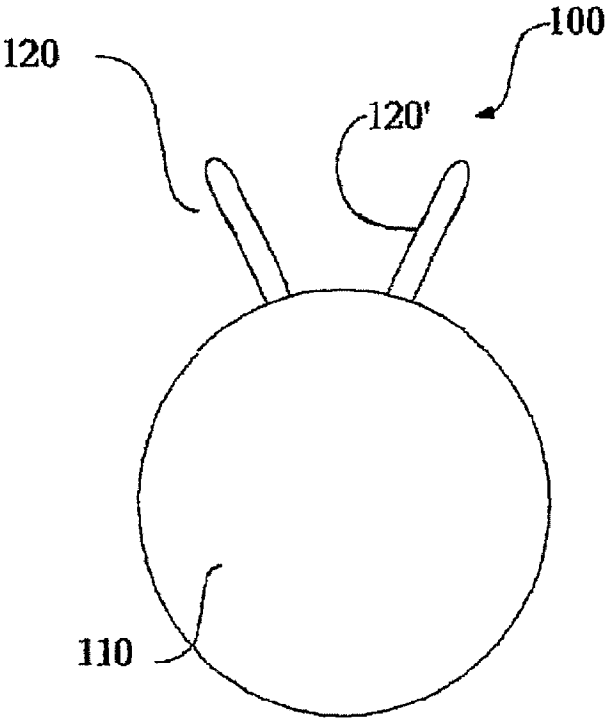
FIG. 1A PRIOR ART
FIG. 1A is a schematic front elevational view of a recreation and play ball according to the prior art.

Prior art related to the presently described play apparatus includes a hopping ball 100, as shown in FIGS. 1A and 1B, which comprises a substantially spherical chamber 110 defined by an elastic body. The upper hemisphere of the elastic body 100 has a pair of radially extending elongated handles 120 and 120'. As shown in FIG. 1B a player 130 can sit on the top of the ball 100 with the ball positioned such that the player 130 can grip one of the handles 120, 120' with each hand.

Described herein are improvements, including a ball that has an eye protrusion extending outward from the surface of the ball. The eye includes an opening through which a member such as a bolt or clevis pin can be passed for attachment of an accessory as discussed below. In an alternative arrangement the ball includes a pair of elongated protrusions generally parallel to each other and extending radially outward from the surface of the ball.

Several illustrated recreation and play balls include one or more water reservoirs in fluid communication with one or more squirt nozzles. The one or more nozzles are disposed on the surface of the ball, on an outwardly facing portion of the handles, or on another type of outward extension. The squirt nozzles are activated by a player via hand manipulation, and may pump or squirt water in one of several manners. For example, the fluid can be pressurized and each time a trigger is depressed the pressurized fluid squirts out a nozzle. Alternatively, depressing the trigger can simultaneously pressurize and release fluid through a nozzle. These are, however, merely examples, and other methods of squirting liquid from squirt nozzles are described below with respect to specific recreation and play balls.

Figure 2:
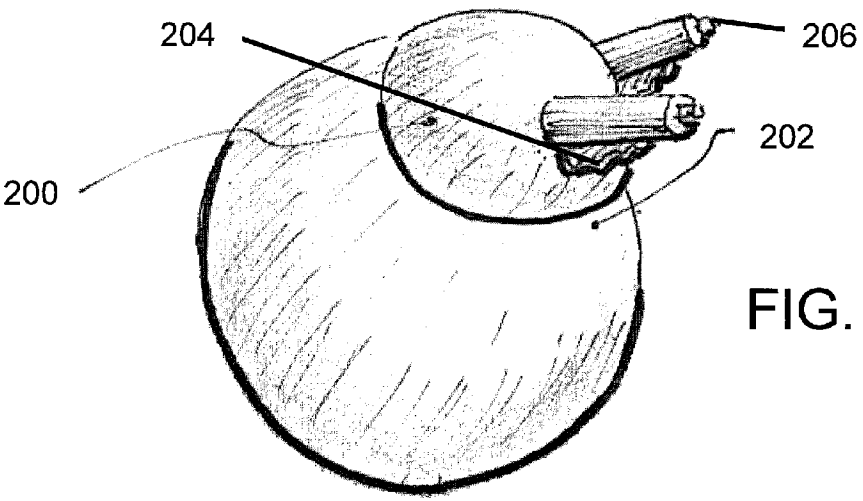
FIG. 2 is a perspective view of a first recreation and play ball having a squirt gun.

FIG. 2 shows a first recreation and play ball including a reservoir 200 externally mounted on the top surface of a ball 202. A user can sit on top of the ball 202 with a leg on either side of the reservoir 200. By squeezing the triggers 204, the player can squirt liquid through the nozzles 206.

Figure 3:
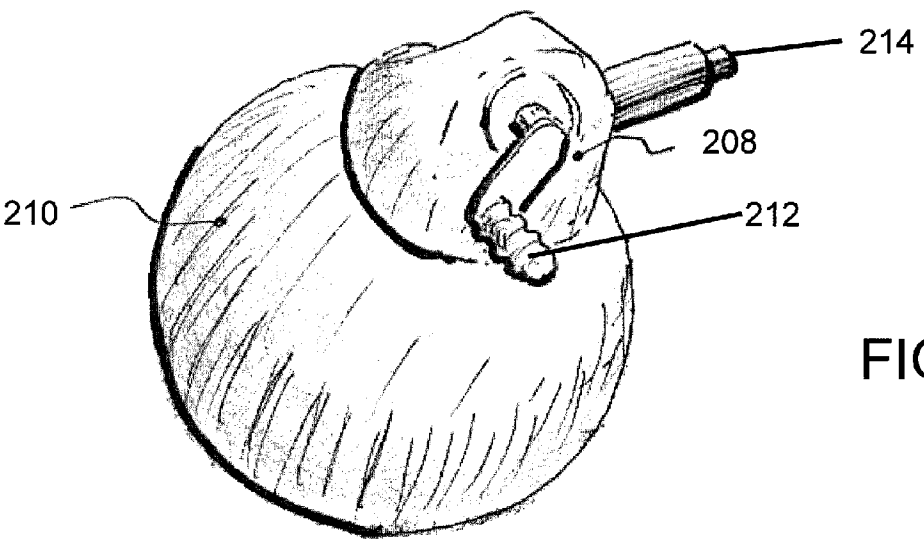
FIG. 3 is a perspective view of a second recreation and play ball having a squirt gun.

FIG. 3 illustrates a second recreation and play ball. The ball includes a reservoir 208 attached to a ball 210. In this recreation and play ball the reservoir 208 includes a peristaltic pump. A user turns a hand crank 212 to operate the peristaltic pump and pump liquid from the reservoir 208. The outlet of the peristaltic pump squirts liquid through the nozzle 214.

Figure 4:
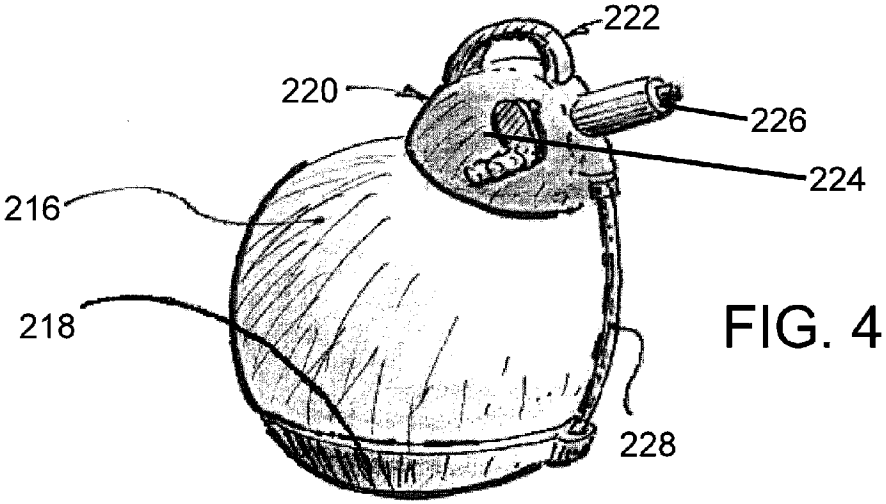
FIG. 4 is a perspective view of a third recreation and play ball having a squirt gun.

FIG. 4 depicts a third recreation and play ball. The ball is similar in function to the ball depicted in FIG. 3. A ball 216 is shown with a reservoir 218 at the bottom of the ball. An assembly 220, including a peristaltic pump, a top handle 222, a crank 224, and a nozzle 226, is located at the top side of the ball 216. The assembly 220 is fluidly connected to the reservoir 218 by a connecting hose 228. In this recreation and play ball a user can sit on the top part of the ball 216 and operate the crank 224. The crank 224 causes the peristaltic pump to draw liquid from the reservoir 218 through the connecting hose 228 and then expel the liquid through the nozzle 226.

Figure 5:
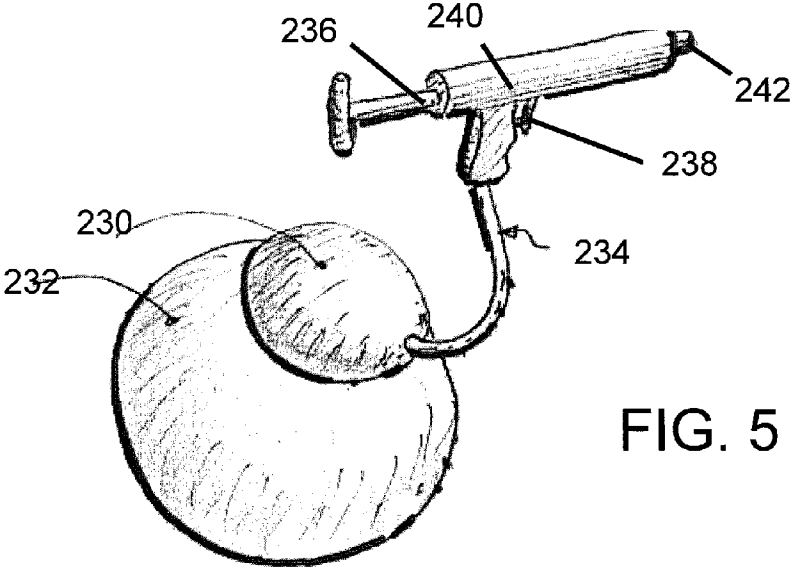
FIG. 5 is a perspective view of a fourth recreation and play ball having a squirt gun.

A fourth recreation and play ball is illustrated in FIG. 5. The ball includes a reservoir 230 externally positioned on the top surface of the ball 232. A flexible tube 234 contains two passageways (not shown) that separately are in fluid communication between a pump unit 240 and the reservoir 230. By activating a pump handle 236, a user is able to deliver pressurized air to the reservoir 230 via one of the passageways. When a trigger 238 is activated by a player, the pressurized air forces liquid to flow from the reservoir, through the second passageway, through the barrel of the pump unit 240, and out through the nozzle 242.

Figure 6:
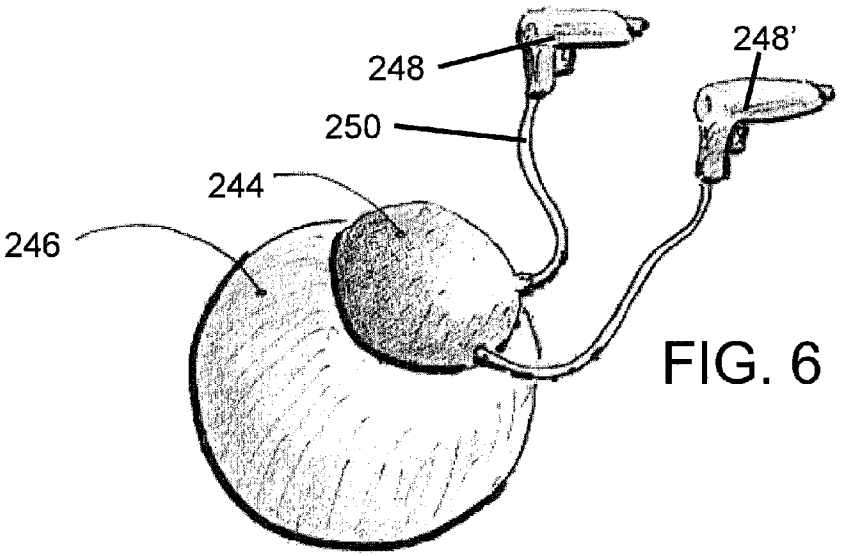
FIG. 6 is a perspective view of a fifth recreation and play ball having a squirt gun.

A fifth recreation and play ball is shown in FIG. 6. A reservoir 244 is located on top of a ball 246. Two squirt guns 248, 248' are fluidly connected to the reservoir 244 via flexible tubing 250. The flexible tubing 250 allows the squirt guns 248, 248' to draw liquid from the supply in the reservoir 244.

Figure 7:
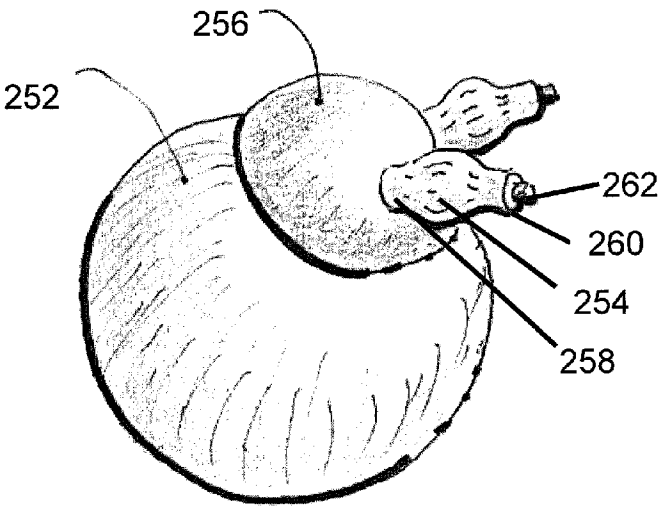
FIG. 7 is a perspective view of a sixth recreation and play ball having a squirt gun.

FIG. 7 illustrates a sixth recreation and play ball. The illustrated ball 252 includes a mechanism whereby the user exerts pressure on a handle to squirt liquid. In the illustrated apparatus, the user squeezes a bulb 254 and releases it to draw liquid from a reservoir 256 through an inner one way valve 258 and into the bulb 254. Squeezing the bulb 254 a second time forces liquid contained therein through an outer one way valve 260 and out of the nozzle 262; the bulb 254 then refills when the bulb is released by the user.

Figure 8:
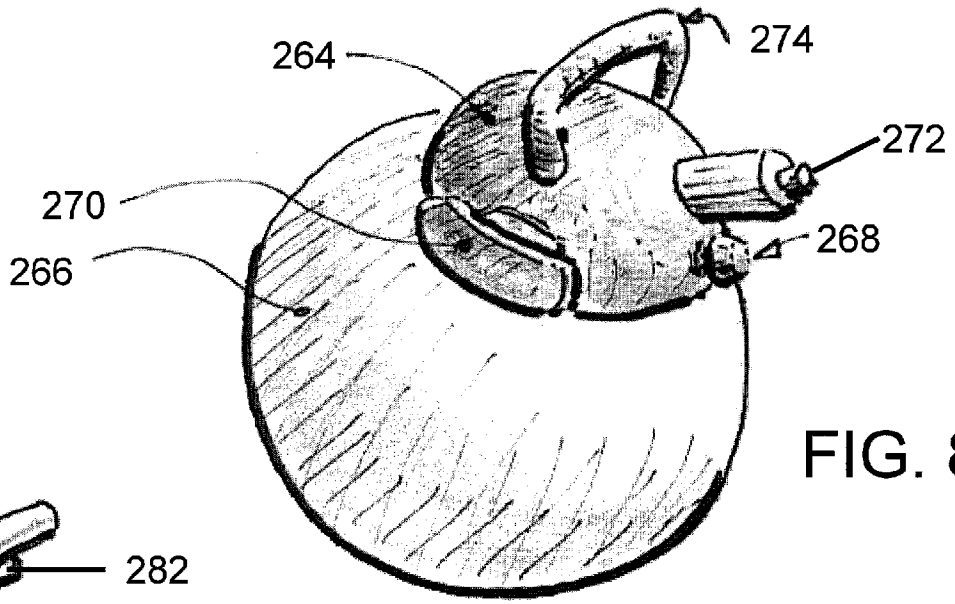
FIG. 8 is a perspective view of a seventh recreation and play ball having a squirt gun.

FIG. 8 shows a seventh recreation and play ball. A reservoir 264 is located on the top of the ball 266. An inlet 268 allows the reservoir 264 to be filled with liquid. A trigger 270 is depressed to pump liquid from the reservoir 264 and out through the nozzle 272. In this specific recreation and play ball, the trigger 270 is positioned to be depressed by a knee of the user sitting on the ball 266 as described above. This illustrated recreation and play ball includes a handle 274 that extends from the reservoir 264 to allow the user to grasp the ball.

Figure 9:
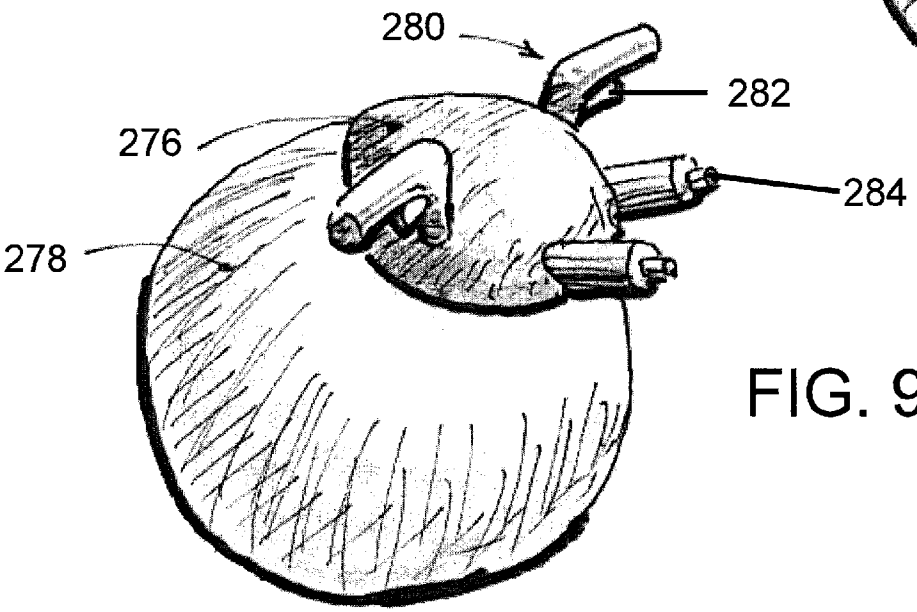
FIG. 9 is a perspective view of an eighth recreation and play ball having a squirt gun.

FIG. 9 depicts an eighth recreation and play ball. A reservoir 276 is positioned at the top of the ball 278 and has two handles 280 which protrude upwardly and outwardly. A trigger 282 on each of the handles 280 activates one or more pumps which draw liquid up from the reservoir 276 and propel it out nozzle 284. The ball may be constructed such that a separate trigger on each handle separately controls an individual nozzle, or may be constructed such that a single trigger is operable to cause water to be expelled from both of the nozzles.

Figure 10:
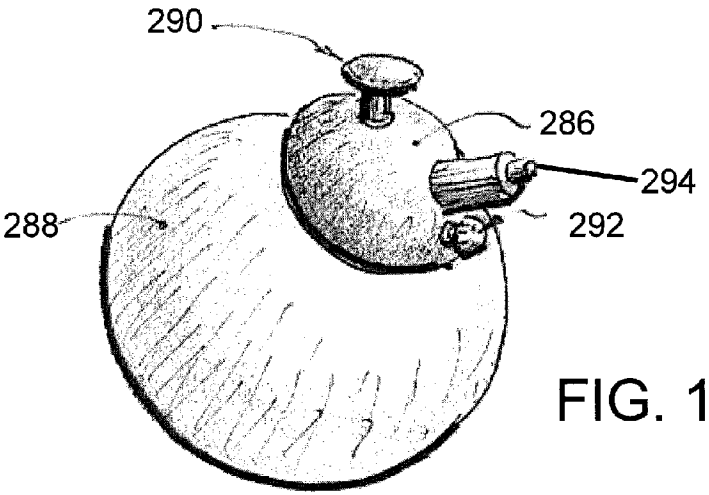
FIG. 10 is a perspective view of a ninth recreation and play ball having a squirt gun.

A ninth recreation and play ball is shown in FIG. 10. A reservoir 286 is located on top of a ball 288 and includes a top mounted pump handle 290. The reservoir 286 has an inlet 292 which allows the reservoir to be filled with liquid. A pump draws liquid up from the reservoir 286 and out through the nozzle 294 when the pump handle 290 is depressed.

Figure 11A:
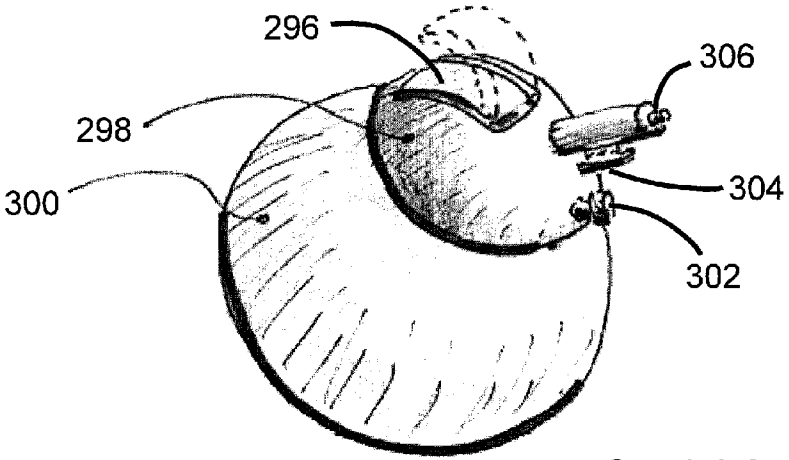
FIG. 11A is a perspective view of a tenth recreation and play ball having a squirt gun.

A tenth recreation and play ball, pictured in FIG. 11A, functions in a fashion similar to the ball of FIG. 10, except that the pump 296 utilizes a lever to pressurize a chamber inside a reservoir 298 on a ball 300. Similarly to the ball shown in FIG. 10, an inlet 302 allows a user to fill the reservoir with liquid. Additionally, there is a trigger 304 to release liquid flow through nozzle 306 when the reservoir 298 is sufficiently pressurized.

Figure 11D:
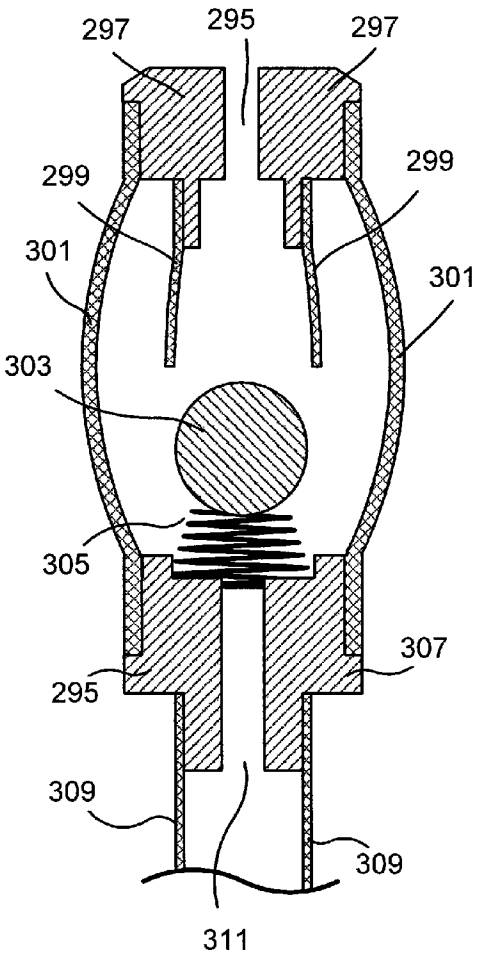
FIG. 11D is a partial cross sectional view of the valve and nozzle assembly shown in FIG. 11C, taken at 90° from the view of FIG. 11C.
Figure 11C:
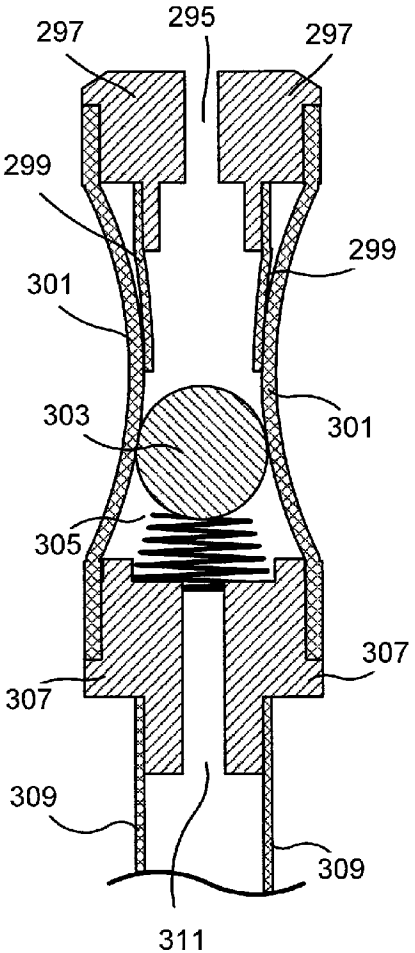
FIG. 11C is a partial cross sectional view of the valve and nozzle assembly shown in FIG. 11B, with the valve opened.
Figure 11B:
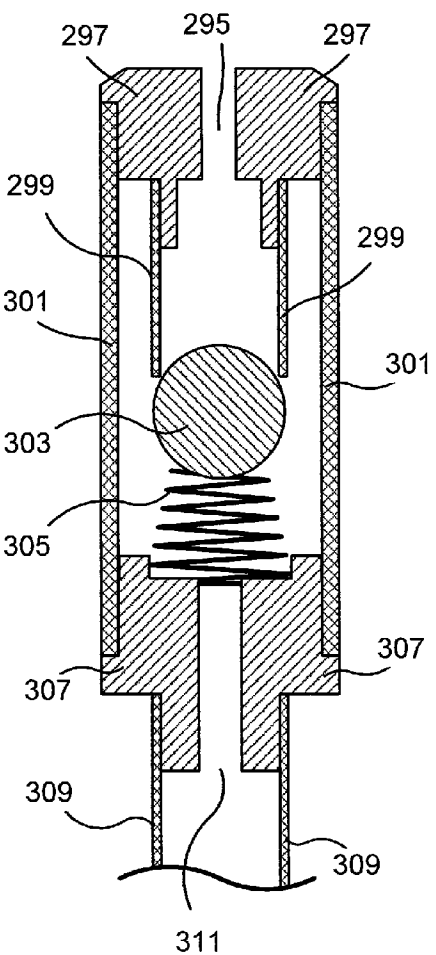
FIG. 11B is a partial cross sectional view of a valve and nozzle assembly for the recreation and play ball, with the valve closed.

FIGS. 11B-D show a valve and nozzle assembly that could be used with a pressurized reservoir of the type shown in FIG. 11A. With this type of system, a valve is closed and prevents liquid flow out of the pressurize reservoir when the system is at rest. A user can squeeze the nozzle and valve assembly to open the valve so that liquid flows through the nozzle 297. In particular, the user may squeeze from any radial direction about the body of the nozzle and valve assembly to open the valve.

FIG. 11B shows a cross-sectional view of the valve and nozzle assembly at rest. A nozzle 297 has an outlet passageway 295 terminating at an orifice from which the liquid is ejected. An outer casing 301, composed flexible tubing, is connected to the nozzle 297 at one end and an inlet coupler 307 at the opposite end, by liquid-tight connections, to for a chamber. The inlet coupler 307 defines an inlet passageway 311 that allows liquid to through the inlet coupler and into the interior chamber of the valve and nozzle assembly. The inlet passageway 311 is in liquid-tight communication with inlet tubing 309, which in turn is in liquid-tight communication with the interior of a reservoir that contains liquid and pressurized air, such as a reservoir of the type shown in FIG. 11A. An inner tube 299, composed of flexible tubing, is attached to the inner side of the nozzle 297 and is in fluid-tight communication with the outlet passageway 295. A ball 303 is positioned to engage the free end of the inner tube 299 to form a liquid-tight seal. One end of a compression spring 305 pushes against a surface of the inlet coupler 307 and the other end of the compression spring 305 pushes against a ball 303 to bias the ball toward the open end of the inner tubing 299. When the system is at rest as shown in FIG. 11B, the ball seats against the inner tubing and forms a seal which prevents fluid from traveling through the valve and nozzle assembly. This maintains pressure within the passageway 311 and in the connected reservoir.

FIG. 11C and FIG. 11D illustrate the valve and nozzle assembly seen in FIG. 11B with the valve open to allow flow through the outlet passageway 295. These two figures are sectional views taken at 90° to one another through the central axis of the assembly. To open the valve, a user squeezes inwardly on some portion of the outer casing 301. FIG. 11C shows portions of both the outer casing 301 and the inner casing 299 deflected inwardly, because a user has applied force directly to the right side and to the left side of the outer casing as viewed in FIG. 11C. FIG. 11D, which shows the same valve and nozzle assembly from the side, illustrates how the force applied to the sides of the valve assembly cause the front and back of the outer casing 301 and the inner casing 299 to deflect or bulge outwardly. When pressure is applied by a user, the ball 303 is displaced downwardly due to the inward deflection of the walls of the outer casing 301 as shown in FIG. 11C. A gap is thus formed between the ball 303 and the inner casing 299, which allows fluid to flow through the valve assembly and out through the nozzle 297. To stop fluid flow the user stops squeezing the outer casing 301. Internal pressure and the elasticity of the outer casing 301 return the outer casing to its original cylindrical shape as shown in FIG. 11B. The spring 305 and fluid pressure together force the ball 303 to re-seat against the internal casing 299, and all fluid flow is stopped.

Figure 12:
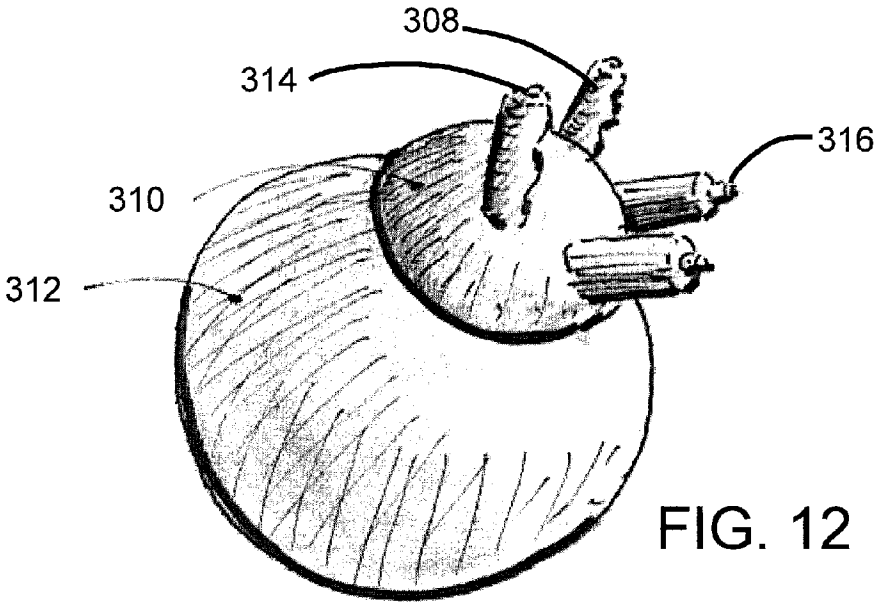
FIG. 12 is a perspective view of an eleventh recreation and play ball having a squirt gun.

An eleventh recreation and play ball is depicted in FIG. 12. Handles 308 are provided on a reservoir 310 which is located on a ball 312. The handles 308 include trigger buttons 314 which can be used to actuate electrical switches. Not shown is the internal source of electrical power, such as a battery, and the electrical wiring which electrically connects the battery, switches, and pump. Each electrical switch controls the activation of an electrical motor which drives a pump, such as a peristaltic pump or reciprocating piston pump. Pushing a button 314 activates the pump and propels liquid out one or both of the nozzles 316.

Figure 13:
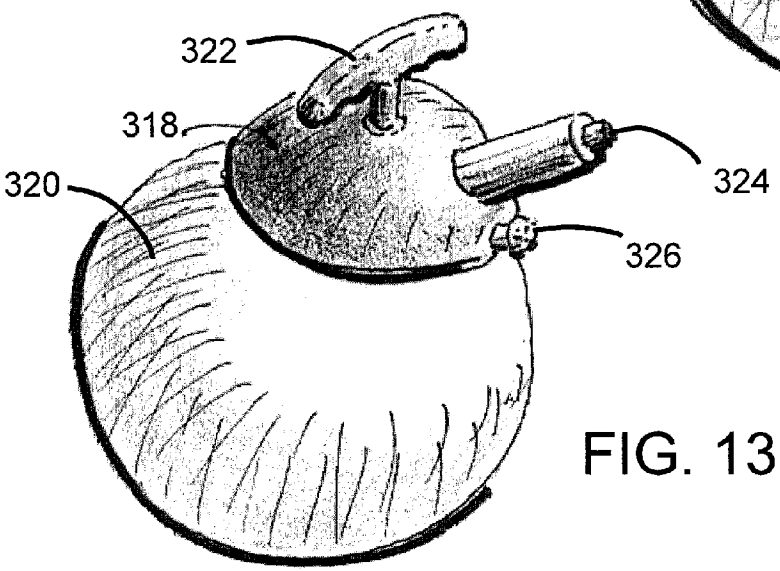
FIG. 13 is a perspective view of a twelfth recreation and play ball having a squirt gun.

FIG. 13 shows a twelfth recreation and play ball. A reservoir 318 is mounted on a ball 320 and includes an integrated spring loaded-handle 322. The handle 322 is spring-loaded such that the spring causes it to retract when it is released. The handle 322 is pulled upwardly to squirt liquid through a nozzle 324. Alternatively, the apparatus can be arranged such that liquid squirts through a nozzle 324 by action of the spring as the handle retracts. A water inlet 326 allows the reservoir 318 to be refilled with liquid.

Figure 14:
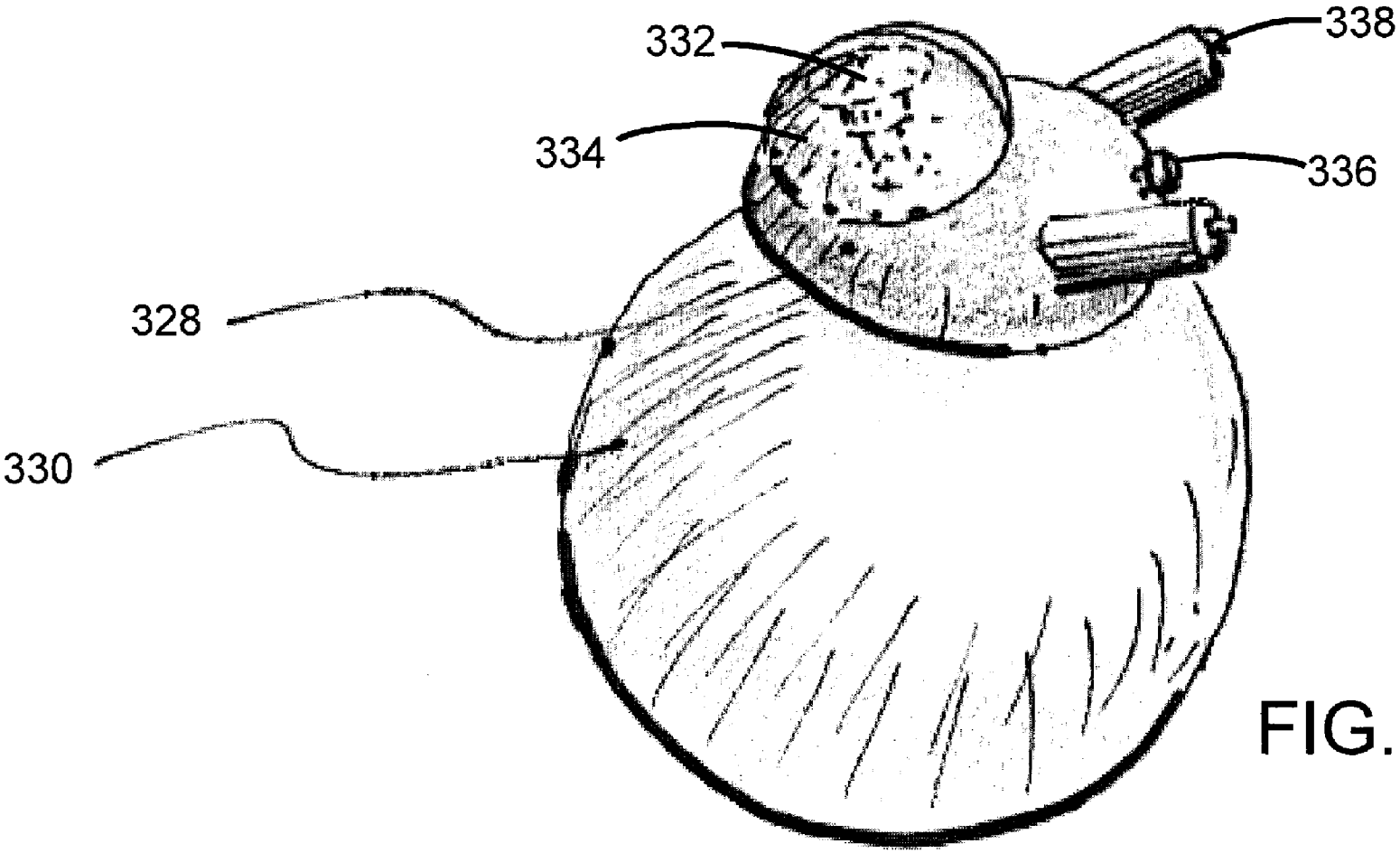
FIG. 14 is a perspective view of a thirteenth recreation and play ball having a squirt gun.

FIG. 14 shows a thirteenth recreation and play ball. A reservoir 328 is located on a ball 330. A portion of the chamber wall of the reservoir 328 is a watertight cover 334 over a spring-loaded syringe 337 disposed within the reservoir. The illustrated cover is in the shape of a dome. The watertight cover 334 is flexible and allows a user to depress the spring loaded plunger of the syringe 332. When the plunger is depressed, liquid is squirted from the nozzle 338. The plunger of the syringe 332 is biased such that, when pressure is removed, it retracts and draws liquid into the chamber of the syringe barrel. An inlet 336 is provided to allow a user to fill the reservoir 328 with liquid.

Figure 15A:
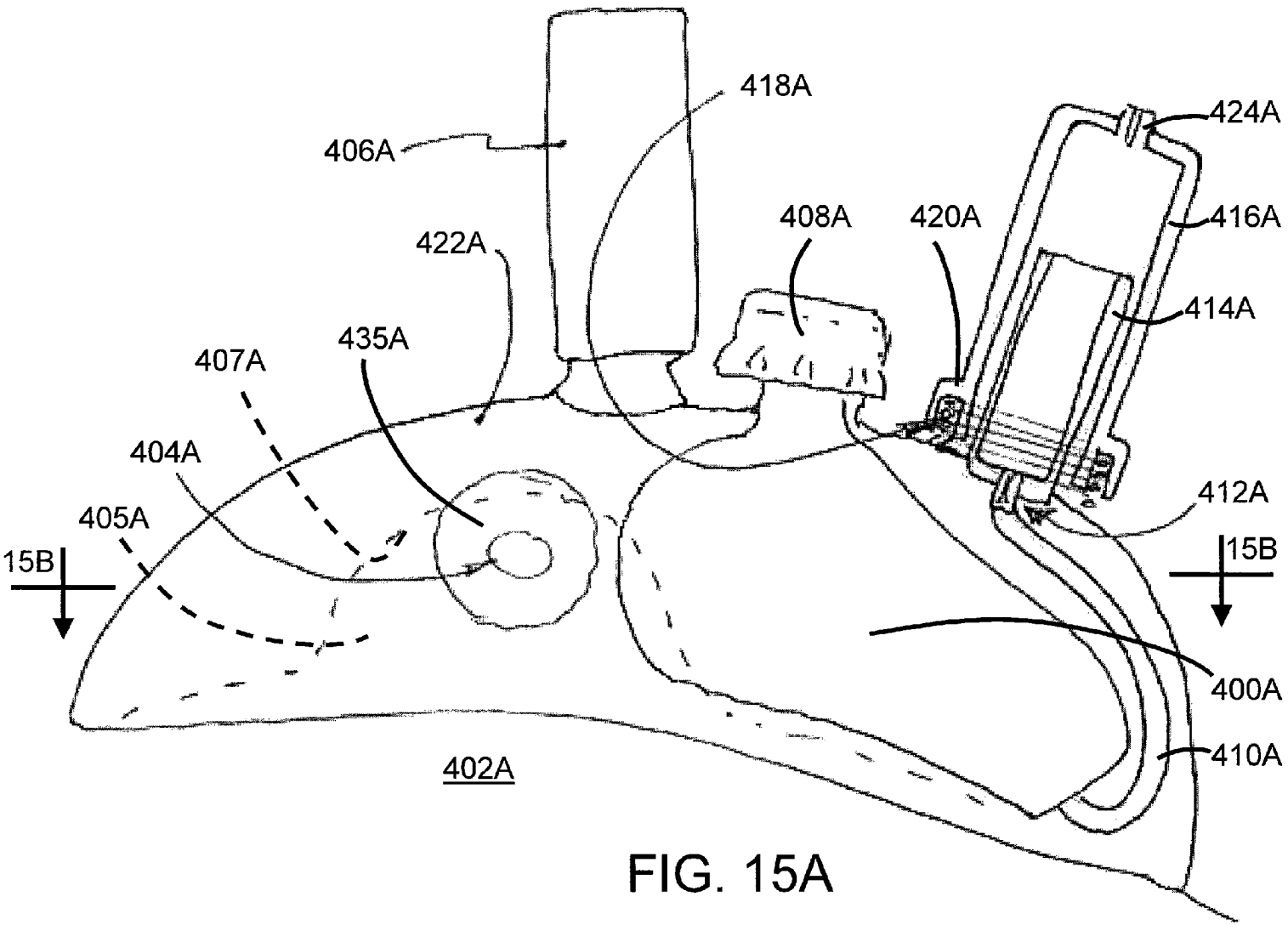
FIG. 15A is a partial elevational view of a fourteenth recreation and play ball having a squirt gun, with a portion broken away to show internal detail.
Figure 15B:
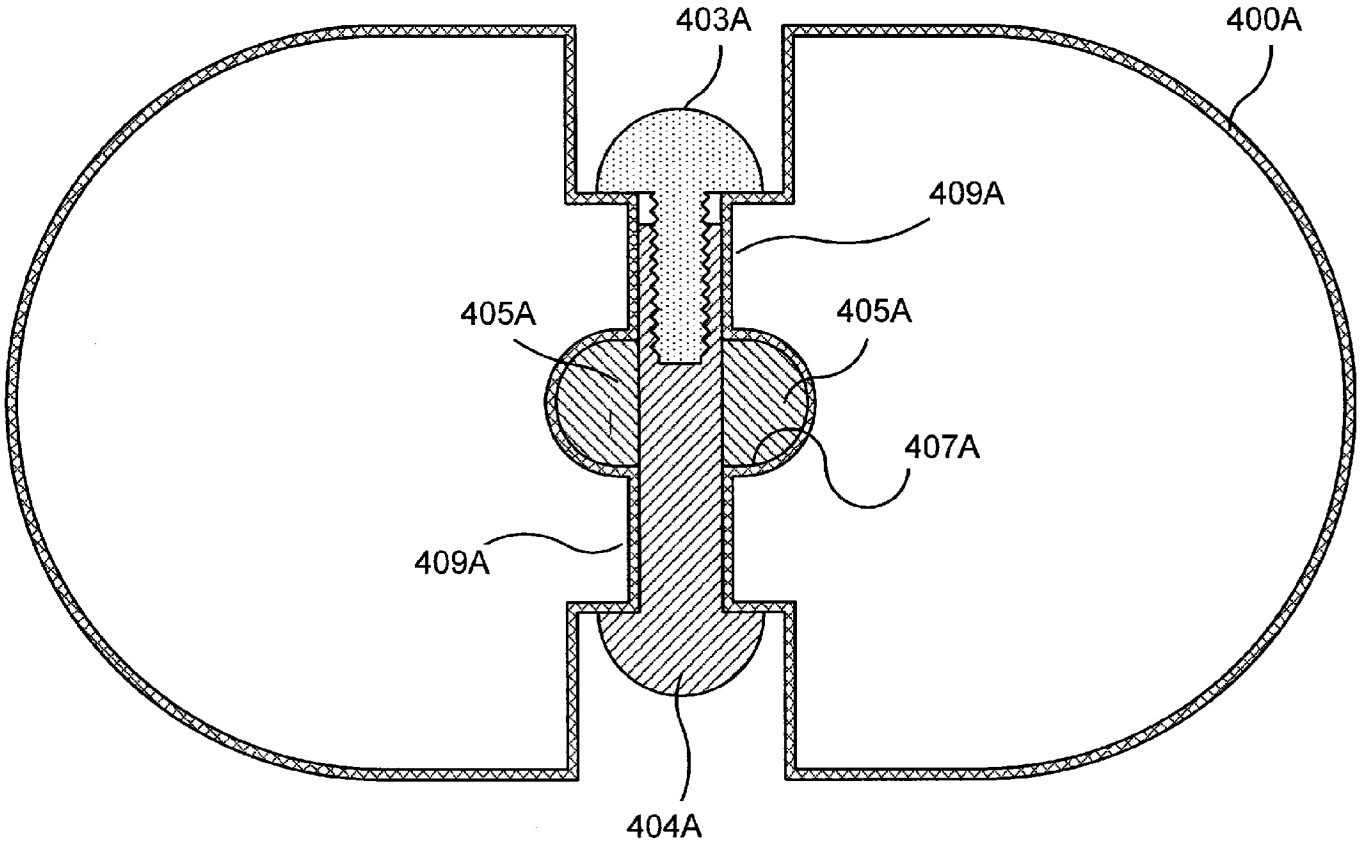
FIG. 15B is a schematic sectional view taken along line 15B-15B of FIG. 15A showing attachment of a clevis on a reservoir assembly to an eye extending from the ball.

A fourteenth recreation and play ball 402A is shown in FIGS. 15A and 15B. This ball includes a mechanism whereby the user moves a handle to squirt liquid. In particular, in the illustrated apparatus, a user squirts by moving the barrel of a syringe-type pump. A reservoir assembly is attached to the ball using a shackle assembly, in particular a clevis-type mount 435A. The surface of the ball is generally spherical, but has an upwardly extending lug 405A. The bottom surface of the reservoir 400A, which faces the ball, is partially generally spherical having the same radius as the outer surface of the ball, but has an indentation 407A sized and shaped to nestingly receive the lug 405A between two clevis arms 409A on the bottom of the reservoir. Each of the lug 405A and the two clevis arms 409A define openings that are in alignment when the lug is received between the clevis arms. To secure the reservoir assembly, a machine screw 403A and a cap nut 404A together extend through the openings defined by the lug 405A and the two clevis arms 409A as shown in FIG. 15B. The head of cap nut 404A faces a first portion of the surface of reservoir 400A. A cavity within cap nut 404A has female threads and receives the screw 403A which is tightened with its head facing a second surface of reservoir 400A. The first and second surfaces are located on the two clevis arms respectively and face in generally opposite directions. The lug 405A is located between the first surface and the second surface. In alternate shackle attachment arrangements, at least one of a nut, a pin, a retaining ring, and a clip (not shown) may be secured to a lug or pin to prevent the reservoir from detaching from the ball 402A.

Returning to FIG. 15A, a non-squirting handle 406A extends from the reservoir assembly. Also extending from the reservoir assembly is a squirting handle that employs the syringe-type pump mechanism. A siphon tube 410A fluidly connects the reservoir 400A to a check valve 412A which is in turn is fluidly connected to the base of a cup 414A having a side wall of a cylindrical cross-section. The check valve 412A allows liquid to flow in one direction from the siphon tube 410A to the cup 414A. Similarly, a check valve/nozzle 424A allows liquid to flow in only one direction, flowing from the expandable chamber defined by the cup 414A and the syringe body 416A to the nozzle tip, where it is expelled. In this arrangement, the cup 414A acts in the manner of a syringe plunger. A mating syringe barrel or body member 416A is mounted to surround and slide relative to the cup 414A. A helical extension spring 418A is positioned around the outer diameter of syringe body member 416A. In the system of FIG. 15, one end of the spring 418A is attached at a location between the syringe body and a flange 420A that protrudes outwardly from the syringe body, with the other end of the spring attached to the reservoir assembly. At least a portion of the spring encompasses portions of both the cup 414A and the syringe body member 416A. The reservoir assembly is covered by an outer flexible skin 422A. The outer flexible skin 422A may be composed of suitably flexible material which may include but is not limited to latex rubber, neoprene rubber, silicone rubber, and thermoplastic polyurethane (TPU). It may be molded in an ornamental or thematic design and colored to create a desired realistic or artistic effect.

To operate the squirting mechanism, a user pushes the syringe body 416A upwardly, extending the spring, whereupon liquid is drawn from the reservoir 400A through the siphon tube 410A, through check valve 412A, and into an expandable chamber defined by the cup 414A and the syringe body. Once the expanded chamber contains a desired amount of liquid, the user releases the syringe body 416A, allowing the extended spring to contract to its normal shape and thereby pull the syringe body downwardly. This causes the syringe plunger 414A to expel the liquid through a combination nozzle/check valve 424A. A user refills the reservoir 400A with liquid through an inlet 408A.

Figure 16:
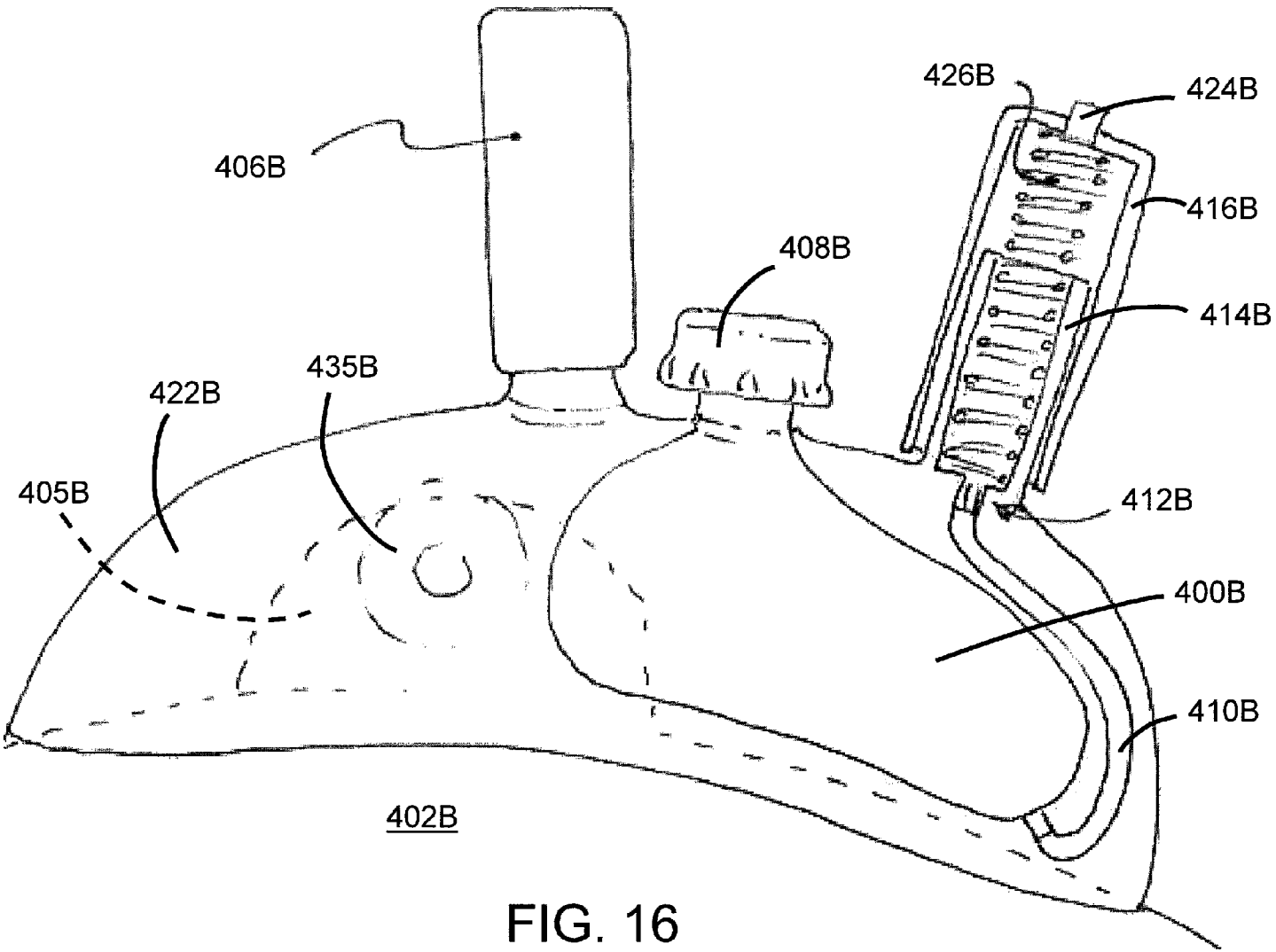
FIG. 16 is a partial elevational view of a fifteenth recreation and play ball having a squirt gun, with a portion broken away to show internal detail.

FIG. 16 shows a fifteenth recreation and play ball. This ball has a variation of the squirting mechanism shown in FIG. 15. Similar elements are labeled with similar numbers, but are distinguished from each other by a subsequent alphabetic designator. A reservoir assembly is attached to a lug 405B on the recreation and play ball 402B by means of a clevis attachment 435B which may comprise a machine screw and a cap nut. In the ball of FIG. 16, a helical compression spring 426B is located within the chamber defined by a cup 414B and a syringe body 416B. One end of the spring 426B faces an interior surface of the syringe body 416B at or near a nozzle 424B and the other end of the spring faces a surface at the bottom of the cup 414B. In the system of FIG. 16, the inlet of the chamber and a check valve 412B also are located at the bottom of the cup 414B. The operation of the squirting mechanism shown in FIG. 16 is similar to the recreation and play ball described above with reference to FIG. 15 with the exception that the user pushes downwardly on the syringe body to the location shown in shown in FIG. 16 to squirt fluid. The user subsequently releases the syringe body, whereupon the spring pushes the syringe body upwardly and refills the chamber. The reservoir assembly is covered by an outer flexible skin 422B.

Figure 17:
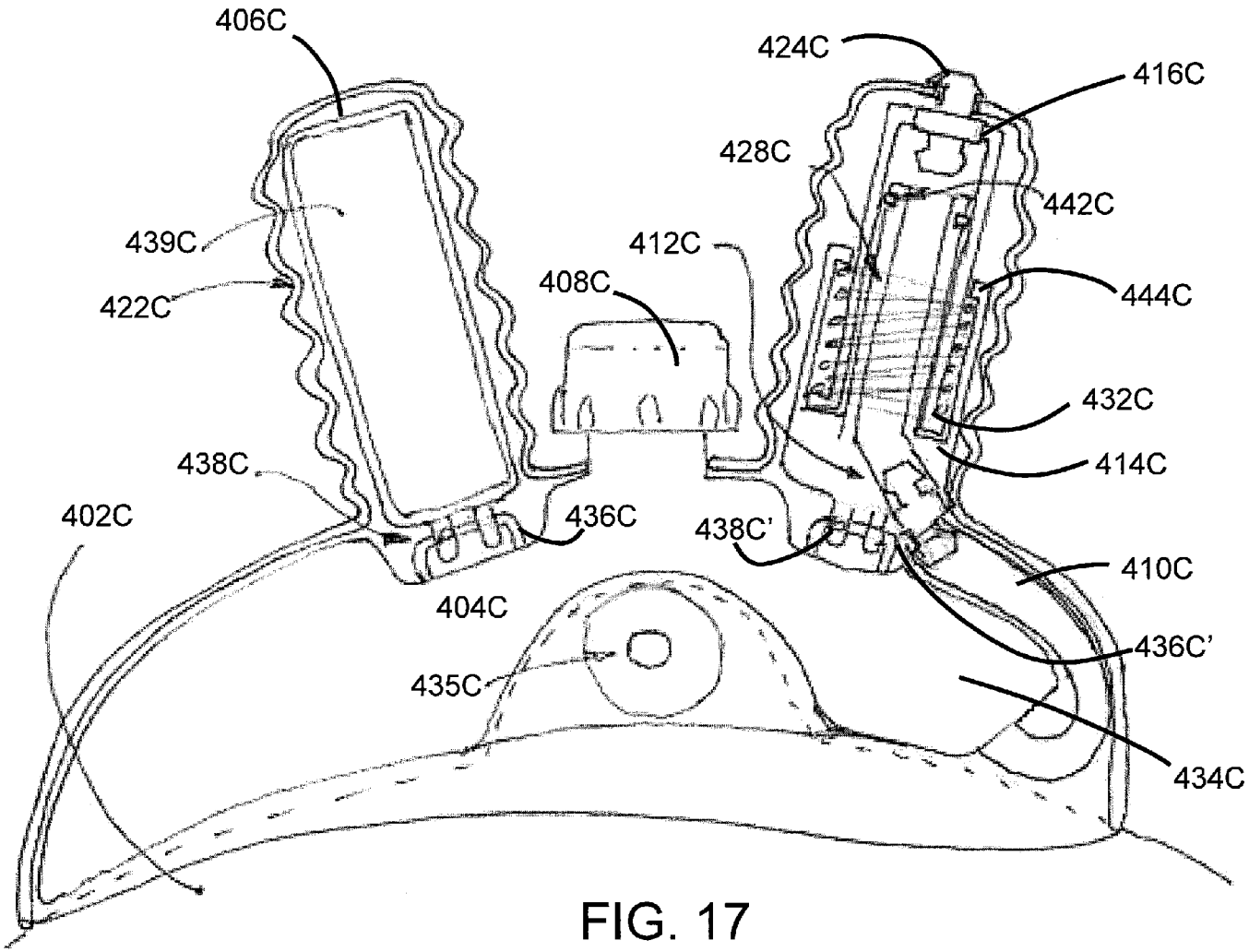
FIG. 17 is a partial elevational view of a sixteenth recreation and play ball having a squirt gun, with a portion broken away to show internal detail.

FIG. 17 shows a sixteenth recreation and play ball. A reservoir assembly includes a clevis attachment 435C to secure a reservoir 434C to a ball 402C. A non-squirting handle 406C and squirting handle are attached to the reservoir 434C via a flexible connection which allows for pivoting movement. A non-squirting handle 406C includes an inner structure 439C. In particular, the reservoir 434C has two upwardly extending attachment arches 436C, 436C'. A handle 406C has two downwardly extending J-type hooks 438C attached to the first reservoir attachment arch 436C. A syringe plunger 414C has two downwardly extending J-type hooks 438C' attached to the second reservoir attachment arch 436C'. An O-ring 442C made of a resilient material is located in the gap between the syringe body 416C and the syringe plunger 414C to form a seal between the syringe body and the syringe plunger. A compression spring 428C is positioned between a flange 432C extending from the syringe body 416C and a flange 444C extending from the syringe plunger 414C. When the spring causes the syringe body 416C to move downwardly, the O-ring 442C and the check valve 412C prevent the water from escaping the chamber from any opening other than then combination nozzle and check valve 424C. It will be understood that such an O-ring may be included as a seal in the other syringe-type systems described herein; and other types of slide-mechanism seals could be used. In the variation illustrated in FIG. 17, an outer flexible skin 422C covers the entire reservoir 434C, except for an opening for filler inlet 408C and a squirting nozzle 424C. The flexible skin 422C shown in FIG. 17 is pleated in the area surrounding the squirt mechanism to allow the flexible skin to extend as the syringe body 416C is extended.

Figure 18A:
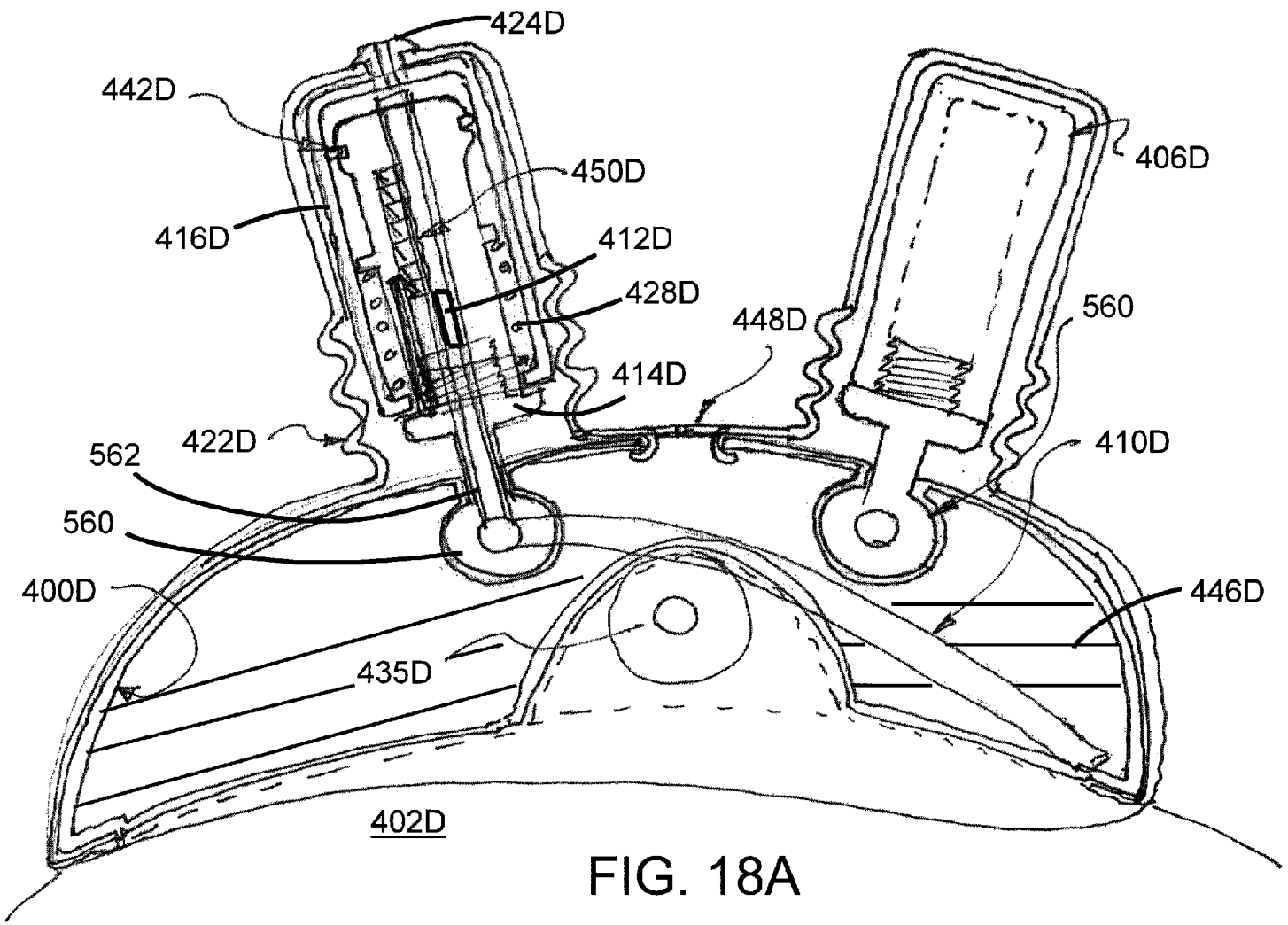
FIG. 18A is a partial elevational view of an seventeenth recreation and play ball having a squirt gun, with a portion broken away to show internal detail.
Figure 18B:
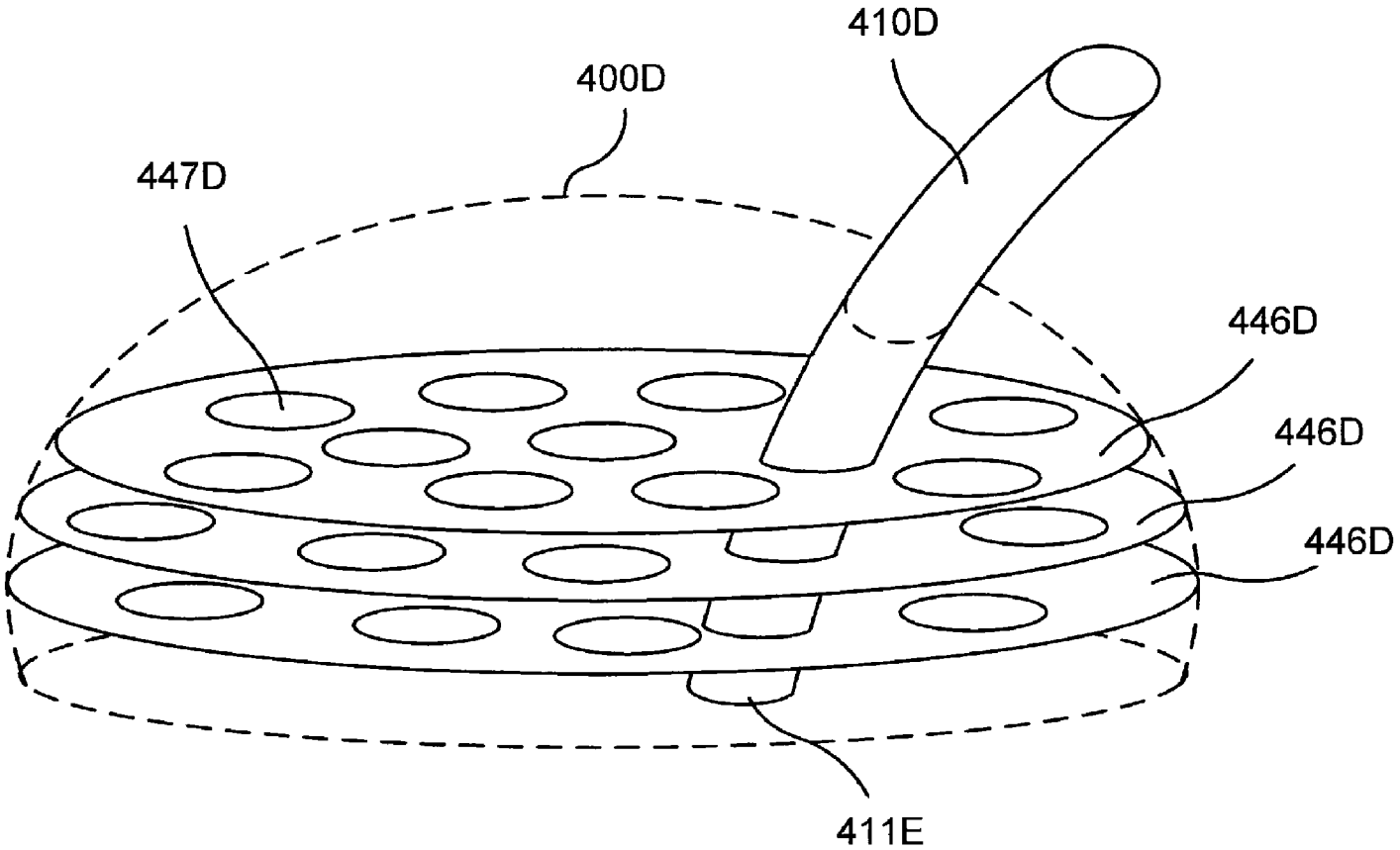
FIG. 18B is a partial elevational view of the reservoir and baffle system used in the eighteenth recreation and play ball, with a portion broken away to show internal detail.

A seventeenth recreation and play ball is illustrated in FIGS. 18A-20. In this ball, the reservoir 400D includes internal baffles 446D. Additional detail of the baffle system is shown in FIG. 18B. Inside reservoir 400D, three layers of internal baffles 446D are shown. Openings 447D in the baffles 446D allow for liquid to travel to the bottom of the reservoir, but slow movement of the liquid when the reservoir is subjected to motion. A simplified depiction of siphon tube 410D is shown penetrating each of the baffles 446D with inlet 411D located at the bottom of the reservoir. The function of the baffles is to limit the movement of liquid within the reservoir 400D so that the inlet 411D of the siphon tube 410D remains submerged, as continuously as possible, in liquid in the reservoir even while the apparatus is in motion. This allows the squirting apparatus to function while the user is bouncing. It will be appreciated that this baffle system can be used with other of the recreation and play balls described herein. An additional feature of the ball illustrated in FIG. 18 is a recessed water inlet 448D. Having a recessed inlet 448D reduces the number of protruding parts prone to impact damage, thus prolonging the useful life of the apparatus.

The recreation and play ball of FIGS. 18A-20 includes a syringe pump assembly having an internal ratchet mechanism 450D. The ratchet 450D allows a user to retain liquid inside the pump without further effort on the part of the user until the ratcheting mechanism is released. In particular, the ratcheting mechanism is configured to hold the squirting mechanism in a ready-to-fire condition until the user is ready to squirt. A user pulls upwardly on the syringe body 416D to draw liquid into a cavity defined by the syringe body. As a user pulls the syringe body 416D upwardly, a pawl progressively engages a series of teeth of the ratchet mechanism, with engagement of the pawl and a tooth preventing the spring from moving the syringe body 416D downwardly. A user can release the syringe body 416D by twisting it to move a pawl out of alignment with the teeth of the ratchet mechanism. When the pawl is disengaged from the teeth, the spring moves the syringe body 416D downwardly and forces liquid out through the nozzle and check valve 424D. Also shown is check valve 412D through which the liquid can flow in only one direction from the reservoir prior to entering the syringe.

The syringe plunger 414D and syringe body 416D may undergo considerable mechanical stress as the squirting mechanisms are used, particularly as they may be used for competitive and sporting play. Depending on the squirting device embodiment used, the user may be using significant pressure on the squirting handles to operate them by moving them upwardly or downwardly as described in various embodiments. In addition, squirting or non-squirting handles may be used to pull upwardly, push downwardly, move forward, move aft, or move laterally, or to rotate the ball, for the purposes of controlling the hopping movement. A flexible connector and/or a pivoting connector in the nature of a ball joint can be used to maximize the life span of squirting recreation and play balls.

Figure 20:
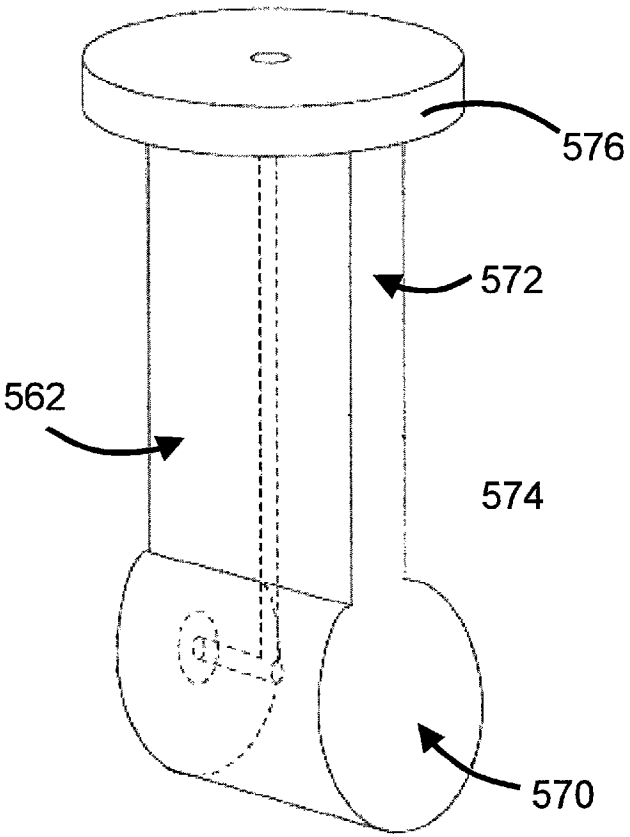
FIG. 20 is an oblique view of a flexible liquid connection support of the recreation and play ball of FIG. 18.
Figure 19:
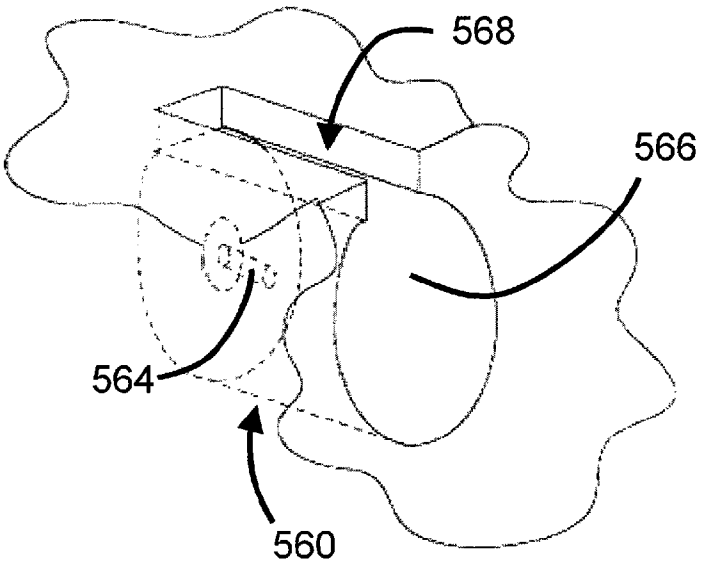
FIG. 19 is a partial oblique view of a mounting feature of the recreation and play ball of FIG. 18.

The ball shown in FIGS. 18-20 has such a flexible and pivoting connector system. FIG. 19 shows a receptacle formed in an upper portion of the wall of the reservoir for connecting a squirt mechanism to the reservoir. The illustrated reservoir is shaped to define a cylindrical hollow 566 and a cut-out portion or slot 568 along the top of the hollow. A barb connector 564 extends outwardly from the base of the hollow and serves as an outlet for the reservoir chamber. FIG. 20 shows a flexible support member 562 which is received by and mates with the cylindrical hollow 566 of FIG. 19. The flexible member 562 includes a generally cylindrical anchor portion 570 and a support portion 572, which in the illustrated system extends radially from the top of the anchor portion and has a rectangular cross-section. A compression fitting 576 is provided at the distal end of the support portion 572. A water feed passageway 574 extends through the anchor portion 570, the support portion 572, and the compression fitting 576 to deliver water from the barb connector to the squirt mechanism. In the illustrated system, the compression fitting 576 is sized and shaped to make a sealed connection between the passageway 574 and the inlet of a squirt system so that, for example, water can flow to the check valve 412D described above with reference to FIG. 18. The anchor portion 570 fits inside the cylindrical hollow 566, and the support portion 572 extends upwardly through the cut-out portion 568. The flexible member 562 is mechanically strong, but sufficiently flexible to not break when flexed during use of the ball. One skilled in the art will recognize that the hollow 566 and the anchor portion 570 can be other shapes such as a cylinder of octagonal or square cross-section, or any other suitable shape. It also will be recognized that the wall of the passageway 574 can be defined by flexible member 562 or can be provided by tubing (not shown) which extends through the flexible member.

Figure 21:
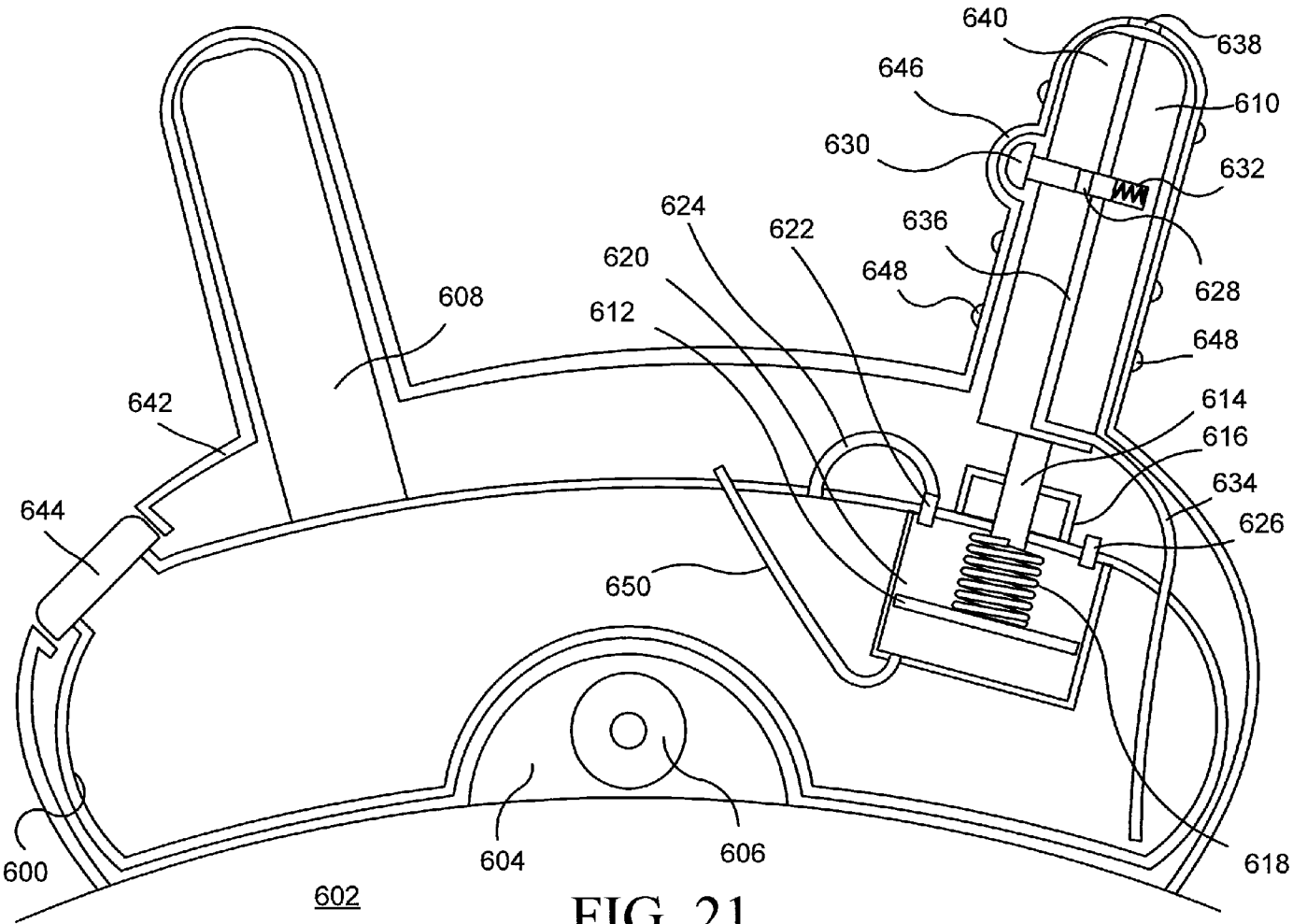
FIG. 21 is a partial elevational view of a nineteenth recreation and play ball having a squirt gun, with a portion broken away to show internal detail.

An eighteenth recreation and play ball, illustrated in FIG. 21, has yet another squirting mechanism. This ball includes a mechanism whereby the user moves a handle to operate a piston and pressurize a reservoir, then activates a trigger to squirt liquid. A reservoir 600 is attached to a ball 602 via a clevis assembly comprising an upward extending eye projection, such as a lug 604, and a clevis pin 606, which may comprise a machine screw and cap nut. A non-squirting handle 608 extends from the reservoir assembly. Also extending from the reservoir assembly is a squirting handle 610. The squirting handle 610 is attached to the reservoir assembly and a pump piston 612 by a shaft 614 which passes through an opening defined by a shaft support member 616. A helical compression spring 618 surrounds the shaft 614 and is caged between the piston 612 and a wall of the reservoir 600. The spring 618 is compressed as the user pulls upwardly on the squirting handle 610. As the pump piston 612 moves upwardly, the volume of the pump chamber 620 is reduced and pressurized air is pushed through a one way valve 622 into a tube 624 and deposited into the reservoir 600. A tube 650 allows ambient air pressure to vent into the lower portion of the pump chamber 620 in order to prevent a vacuum from developing during movement of the piston 612. When the user is no longer pulling upwardly, the pump piston 612 is pushed downwardly by the compression spring 618, drawing ambient air into the pump chamber 620 via a one way valve 626. The result of numerous cycles of the pump piston 612 is an increased pressure in the reservoir 600. The diameter of the pump piston 612 is selected so that a minimal stroke length will result in adequate pressurization of the reservoir 600 to between 10 to 30 psi in a minimal number of strokes. Minimizing the stroke length reduces the movement of the squirting handle relative to the ball and improves the control of the ball in response to user input. The spring should be selected so that the force required for the user to move the pump piston 612 does not exceed the strength of either the child or adult user for which the product is designed. Alternate arrangements may include a double acting pump mechanism that uses springs to push a piston toward a center position and thus pump pressurized air into the reservoir 600 when the piston is moved either upwardly or downwardly.

Pressure in the reservoir 600 is maintained when a valve 628 is in the closed position. A trigger 630 activates the valve 628 which is seated in the closed position by a compression spring 632. The trigger 630 is located on the squirting handle 610 so that the user may activate the trigger with a movement of the thumb radially inwardly toward the axis of the handle. In an alternate embodiment, the trigger is located at a position such that the user can press it with a forefinger. When the user depresses the trigger 630 and thereby opens the valve 628, the pressurized air inside of the reservoir 600 pushes liquid through a pickup tube 634 which is in fluid connection with a passageway 636 in the squirting handle 610. The liquid moves from the passageway 636, through the valve 628 and is expelled through a hole 638 in a nozzle 640 on the squirting handle 610.

In the ball of FIG. 21, a flexible cover 642 surrounds the upper portion of the reservoir assembly with the exception of an opening for an inlet 644 and the hole 638. The user refills the reservoir 600 with liquid through the inlet 644. One or more textured or raised bumps 646 in the flexible cover 642 indicate the location of the trigger 630 on the squirting handle 610. One or more tactile rings 648 are aligned around the circumference of the squirting handle portion of the flexible cover 642 in order to improve the user's grip and to provide a guide in locating the position of the trigger bump 646.

The recreation and play balls of FIGS. 15-21 each depict one squirting and one non-squirting handle attached to a reservoir assembly. Alternate embodiments of the recreation and play balls may include any possible combination of singular or multiple squirting and singular or multiple non-squirting handles. In addition, the arrangement and number of these handles may be used to enhance the play value by adding to the aesthetic appeal of the recreation and play balls. An example of this would be the use of two non-squirting handles and two squirting handles to resemble the four teats found on the udder of a cow.

Figure 22:
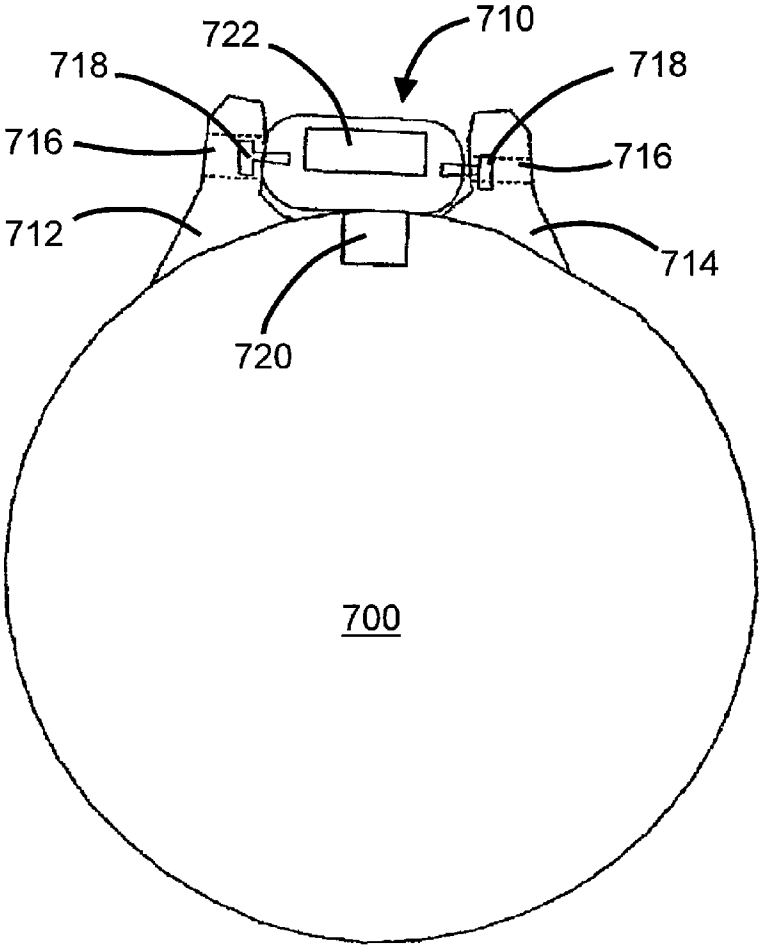
FIG. 22 is a schematic front elevational view of a recreation and play ball having a display for counting and related educational games.

FIG. 22 shows a recreation and play ball 700 which includes a device for counting and/or displaying the number of bounces by a user. An analog or digital electronic counting and display module 710, having a display such as an LCD screen, is provided to communicate visual output to a user responsive to bouncing of the ball against a surface. The module 710 is mounted externally to the hopping ball 700 using a first protrusion 712 and second protrusion 714 as mounts. Each protrusion 712, 714 includes a through hole 716, through which is inserted a mounting screw 718 that fits a corresponding threaded socket on the side of the electronic module 710. The electronic module 710 is responsive to a pressure transducer 720 located inside the ball 700, and thus is operative to count or tally the jumps and thereby producing a visual output on the display 722 of the electronic module 710. The protrusions 712, 714 used for mounting the electronic module 710 may be sized and shaped to serve as handles, or one or more separate handles may be provided. Not shown is the internal electrical power source, such as a battery, and electrical wiring which electrically connects the battery, electronic module 710, pressure transducer 720, and display 722.

Balls of the type shown in FIG. 22 can have one or more additional features such as other types of sensors for detecting bounces or the height to which the user is bouncing, a computer or other tabulation device for counting the bounces or calculating the rate at which the user is bouncing, software for operation of a computer, or application software for playing games while using the ball. An electrical circuit or mechanical apparatus (not shown) may be provided to communicate audio output to a user when the ball is bounced against a surface. The apparatus can be constructed such that the visual and/or audio output is responsive to at least one of the rate of bouncing, the height of bouncing, and the total number of bounces.

Figure 23:
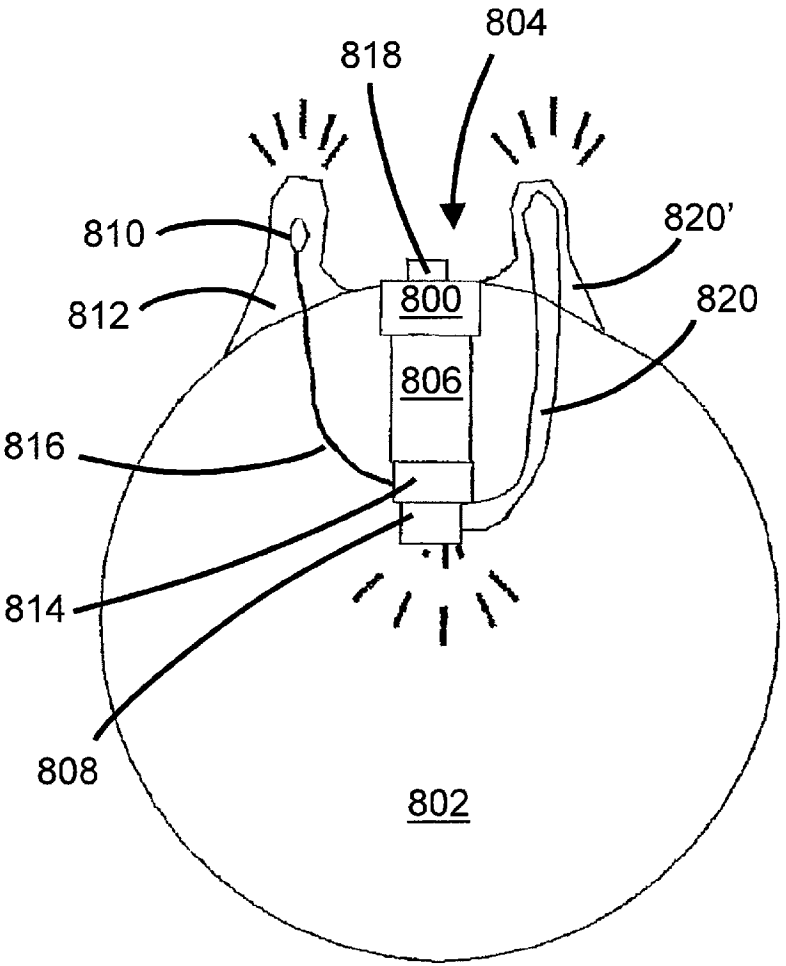
FIG. 23 is a schematic front elevational view of a recreation and play ball having lighting capabilities.

Another recreation and play ball, as shown in FIG. 23, includes a device for generating light in response to the player's bouncing activity. One or more lights are responsive to change in internal pressure as determined by a transducer 800 located within the interior 802 of ball 804. Batteries 806 are included to power one or more light bulbs 808, 810. Circuitry can be provided such that the visual output to the user is in the form of lights corresponding to each bounce, the rate of bouncing, the height of bouncing, or the total number of bounces.

In one arrangement, the light bulb 810 is a light emitting diode embedded in a transparent handle 812. The light bulb 810 is connected to a power supply 814 via a cable 816. The power supply 814, including the batteries 806, is operative to supply current to one or more of the light bulbs 808, 810 in response to signals from the pressure transducer 800 and/or the position of a user-operated switch 818. Light also is transferred by a fiber optic cable 820 or some other conduit that is operative to provide internal reflection of light to the surface of the hopping ball 804, and in this example to the transparent handle 820'. It will be appreciated that the lighting mechanism may contain two or more light emitting diodes as described or two or more fiber optic cables as described. Or transparent or translucent handles may be internally illuminated by another method or combination of methods that are known in the art.

Figure 24:
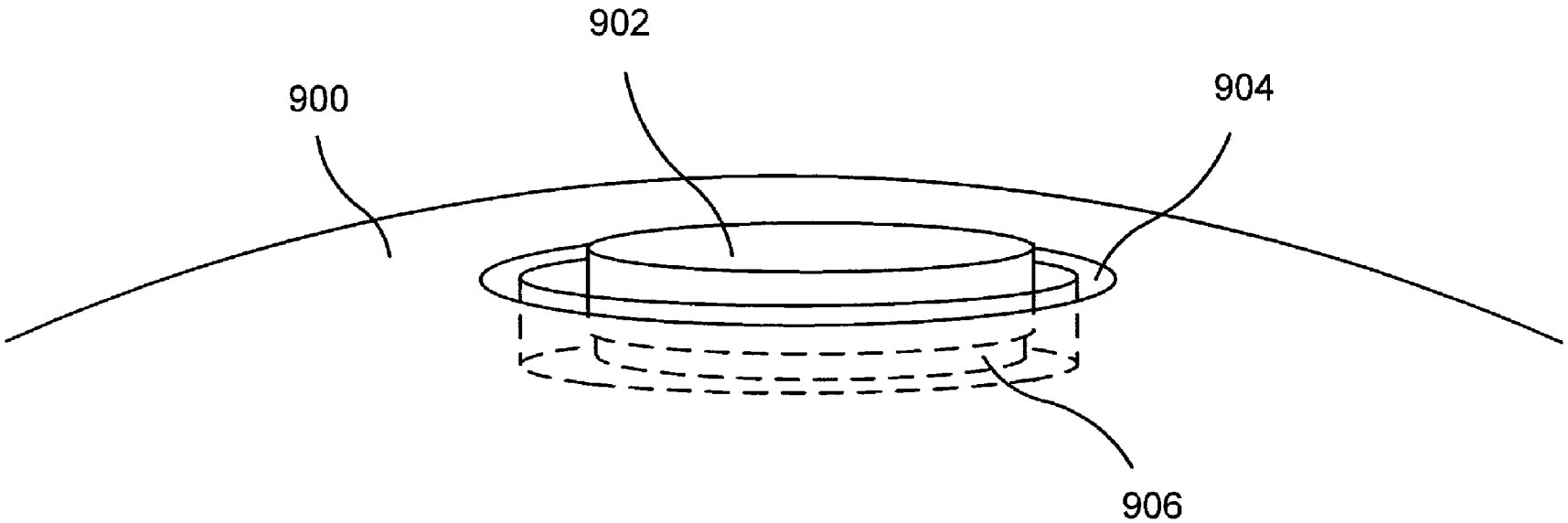
FIG. 24 is a partial elevational view of the play ball showing an inflation and deflation valve.

FIG. 24 shows a valve used to inflate or deflate a play ball. The diameter of the valve opening may be sized to accommodate a range of inflation devices. In one arrangement, the opening is large enough to accommodate the rapid inflation and deflation of the ball, for the maximum convenience of the user. The ball surface 900 is manufactured with a seat 904.

Methods of manufacture include the use of a seat 904 which is placed into a rotomold prior to formation of the rest of the ball. After rotomolding is complete, an additional step is required to clear material from the opening of the valve. This creates a part which is widely known in the art as "in-molded." Another method of manufacture is an adhesive process, whereby the seat 904 is a part that is adhesively bonded to an opening in the ball 900. A cap or plug 902 is secured to the stem 906 by means which ensure an airtight seal. Best results are achieved when the material of the seat 904, stem 906, and cap or plug 902 is a plastic with a higher durometer rating than that of the ball.

Any of the previously mentioned recreation and play balls may be shaped and/or provided with indicia which make it resemble an animal or sports related object. Examples of these themes include, but are not limited to: cow, donkey, elephant, duck, pig, cobra, camel, dinosaur, kangaroo, teddy bear, horse, monkey, basketball, baseball, and football helmet. The elastic body need not be substantially spherical. The ball or bouncing object may have any shape as long it is an elastic body that allows a user to bounce up and down. Any associated reservoir, handle, or nozzle may be covered by a flexible cover with an exterior shape and/or coloration comporting with the desired theme of the ball.

While multiple recreation and play balls have been described, the description is not intended to limit the scope of the disclosure to the particular forms set forth, but to the contrary, is intended to cover such alternatives, modifications, and equivalents as may be within the spirit and scope of the following claims.

The invention claimed is:

1. A play apparatus comprising:

an inflatable elastic ball that has a generally spherical outer surface and that is configured such that a user can sit on top of the ball and can bounce while sitting on top of the ball;

a reservoir attached to the outer surface of the ball at an anchoring region of the reservoir, the reservoir being located outside of the ball and defining a chamber adapted to contain a body of liquid;

at least one handle positioned to allow a user to grasp the play apparatus while sitting on top of the ball;

at least one orifice disposed on an external surface of the play apparatus, the at least one orifice being in liquid communication with the chamber and being positioned to direct a stream of liquid to a location distant from the ball; and a pump mechanism operative to expel liquid contained in the chamber through the at least one orifice to a location distant from the ball, the pump mechanism including an apparatus manipulatable by the user to control the flow of liquid from the chamber to the at least one orifice.

2. The play apparatus of claim 1 wherein the reservoir has a surface that faces the ball and that conforms to a portion of the generally spherical outer surface of the ball.

3. The play apparatus of claim 1 wherein the pump mechanism is at least one of a syringe-type pump, peristaltic-type pump, and a piston-type pump.

4. The play apparatus of claim 1 wherein the pump mechanism comprises:

a body which defines a cavity; and a ratcheting mechanism configured to allow liquid to be drawn into the cavity and retained inside the cavity without further effort on the part of the user until the ratcheting mechanism is released.

5. The play apparatus of claim 1 wherein the apparatus manipulatable by the user to control the flow of liquid is a trigger that is attached to the at least one handle.

6. The play apparatus of claim 1 wherein the apparatus manipulatable by the user to control the flow of liquid is a trigger that is attached to the reservoir.

7. The play apparatus of claim 1 wherein the pump mechanism comprises a crank that is affixed to the reservoir and that is operative to expel liquid contained in the chamber through the at least one orifice when turned by a user.

8. A play apparatus according to claim 1 wherein the ball member has a large port for the purpose of rapid inflation and deflation.

9. A play apparatus according to claim 8 wherein the port comprises an inmolded seat for a cap or plug of a plastic material.

10. A play apparatus according to claim 9 wherein the inmolded seat and the cap or plug have a durometer rating that is higher than a durometer rating of the rest of the ball.

11. The play apparatus of claim 1 wherein the at least one handle comprises:

a first elongated handle that extends outwardly from the reservoir; and a second elongated handle that extends outwardly from the reservoir, with the first and the second elongated handles being positioned to allow a user to grasp both the first and second elongated handles when the user is sitting on top of the ball.

12. The play apparatus of claim 1 further comprising an outer cover that is comprised of an elastic material configured to cover the reservoir and the at least one handle and that further defines at least one opening for the at least one orifice.

13. The play apparatus of claim 12 wherein the outer cover is configured such that the apparatus resembles a sports ball.

14. The play apparatus of claim 1 wherein the reservoir includes at least one baffle disposed inside the chamber and configured to limit the movement of liquid inside of the chamber while the play apparatus is in motion.

15. A play apparatus comprising:

a ball configured such that a user can sit on top of the ball and can bounce while sitting on top of the ball;

a reservoir attached to the ball at an anchoring region of the reservoir, the reservoir defining a chamber adapted to contain a body of liquid;

a cover that surrounds at least a portion of the reservoir;

a recessed water inlet that is generally flush with an outwardly facing surface of the cover;

at least one handle positioned to allow a user to grasp the play apparatus;

at least one orifice disposed on an external surface of the play apparatus, the at least one orifice being in liquid communication with the chamber and being positioned to direct a stream of liquid to a location distant from the ball; and a pump mechanism operative to expel liquid contained in the chamber through the at least one orifice to a location distant from the ball, the pump mechanism including apparatus manipulatable by the user to control the flow of liquid from the chamber to the at least one orifice.

16. The play apparatus of claim 1 wherein the at least one handle is affixed to the outer surface of the reservoir via a flexible connector.

17. The play apparatus of claim 16 wherein the flexible connector comprises a flexible support member.

18. The play apparatus of claim 16 wherein the flexible connector comprises a ball joint.

19. The play apparatus of claim 16 wherein the flexible connector comprises at least one J hook.

20. The play apparatus claim 1 further comprising a sensor operable to communicate visual or audio output to a user when the ball is bounced against a surface.

21. The play apparatus of claim 20 wherein the visual or audio output is responsive to at least one of the rate of bouncing, the height of bouncing, and the total number of bounces.

22. The play apparatus of claim 21 wherein the visual or audio output enables the user to play interactive games.

23. The play apparatus of claim 21 wherein the sensor includes a light configured to react in response to a signal from the sensor.

24. The play apparatus of claim 23 wherein the sensor includes an analog display.

25. The play apparatus of claim 1 wherein:

the pump mechanism is operable to pressurize air inside the chamber; and the at least one orifice is in communication with the chamber in such an arrangement that pressurized air in the chamber can forcibly expel liquid through the at least one orifice.

26. The play apparatus of claim 25 wherein the apparatus manipulatable by the user is a valve located between the chamber and the at least one orifice.

27. The play apparatus of claim 26 wherein:

the valve has a valve body located at a position where the valve body can be grasped by a user; and the valve is configured to open and allow a flow of liquid when a user squeezes the valve body.

* * * * *